US005532803A

United States Patent [19]

Yasuda et al.

[11] Patent Number: 5,532,803

[45] Date of Patent: Jul. 2, 1996

[54] DEVELOPING APPARATUS WITH IMPROVED TONER CONVEYANCE

[75] Inventors: Kazuo Yasuda; Satoshi Takahashi, both of Hachioji, Japan

[73] Assignee: Konica Corporation, Tokyo, Japan

[21] Appl. No.: 212,921

[22] Filed: Mar. 15, 1994

[30] Foreign Application Priority Data

Mar. 18, 1993 [JP] Japan ..... 5-058872

[51] Int. Cl.[6] ..... G03G 15/09

[52] U.S. Cl. ..... 355/251; 118/645; 118/658; 355/326 R

[58] Field of Search ..... 355/245, 251, 355/252, 253, 254, 255, 259, 260, 326 R, 327, 246; 118/657, 568, 645; 430/102

[56] References Cited

U.S. PATENT DOCUMENTS

| | | | |
|---|---|---|---|
| 4,254,202 | 3/1981 | Matsumoto et al. | 118/657 X |
| 4,504,136 | 3/1985 | Yoshikawa et al. | 118/658 X |
| 4,676,192 | 6/1987 | Yuge et al. | 118/658 |
| 4,811,686 | 3/1989 | Yamane | 118/657 |
| 4,814,820 | 3/1989 | Hirahara et al. | 118/657 X |
| 4,844,008 | 7/1989 | Sakami et al. | 118/658 |
| 5,030,996 | 7/1991 | Tajima et al. | 355/246 |
| 5,234,786 | 8/1993 | Ueda et al. | 430/102 X |

FOREIGN PATENT DOCUMENTS

| | | |
|---|---|---|
| 62-191868 | 8/1987 | Japan . |
| 62-191869 | 8/1987 | Japan . |
| 1-282578 | 11/1989 | Japan . |

*Primary Examiner*—Arthur T. Grimley
*Assistant Examiner*—Shuk Y. Lee
*Attorney, Agent, or Firm*—Finnegan, Henderson, Farabow, Garrett & Dunner

[57] ABSTRACT

A developing unit in use with an image forming apparatus such as a printer and a copier. The developing unit includes: a photoreceptor for holding a toner image; two-component developer consisting of toner and magnetic carrier; a developing sleeve, located in a vicinity of the photoreceptor and slightly separated from the photoreceptor, for supplying the toner of the two-component developer to the surface of the photoreceptor; a developer layer thickness regulator for regulating a layer thickness of the two-component developer provided on a rotatable surface member of the developing sleeve; and a developing bias generator for applying a developing bias voltage, including an AC component, onto the developing sleeve. The developing sleeve further including: the rotatable surface member for conveying the two-component developer; plural magnetic poles each of which is fixed at a respective predetermined location in the rotatable surface member. In the developing unit, layer thickness $H_D$ (mm) of the two-component developer and gap $D_{SD}$ (mm), between the surface of the photoreceptor and the rotatable surface member, both at the location where the rotatable surface member is closest to the surface of the photoreceptor, satisfies the equation of $0.02 \leqq D_{SD}-H_D \leqq 0.3$; and the toner of the two-component developer is conveyed to the surface of the photoreceptor between 5 and 40 mg/cm$^2$ at the location, where the rotatable surface member is closest to the surface of the photoreceptor.

3 Claims, 4 Drawing Sheets

DEVELOPING APPARATUS WITH IMPROVED TONER CONVEYANCE

BACKGROUND OF THE INVENTION

The present invention relates to a developing apparatus for the development of a latent image formed on an image forming body used for an electrophotographic image forming apparatus.

Compared with 1-component-developer composed of magnetic toner without using magnetic carrier, 2-component-developer, in which toner and magnetic carrier are mixed, is advantageous in that: the toner can be easily subjected to triboelectric charging control; and the toner is seldom coagulated. Therefore, when 2-component-developer is used, toner transfer can be effectively controlled by a development electric field. Accordingly, where a color image is developed by color toner, high image quality can be provided. Consequently, 2-component-developer is frequently used although the quantity of toner with respect to carrier must be controlled.

The 2-component-developer is used in the following developing apparatuses: a developing apparatus in which a developing sleeve is fixed, and a magnet, in which a plurality of N and S poles are circumferentially disposed, is rotated in the developing sleeve; a developing apparatus in which a developing sleeve and a magnet are rotated together; and a developing apparatus in which a developing sleeve is rotated, and the poles of a magnet provided in the developing sleeve are fixed. In a developing apparatus in which the magnet provided in the developing sleeve is rotated, high torque must be applied to the magnet to rotate at high speed. Therefore, vibrations are caused, and the rotational mechanism is complicated, and further the apparatus must be strong and large. For this reason, a developing apparatus, in which a developing sleeve is rotated, and the poles of a magnet provided in the developing sleeve are fixed is widely used. In this developing apparatus with a rotated sleeve and fixed magnet poles, developer is deposited onto the surface of the developing sleeve by the action of the magnet provided in the developing sleeve, and when the developing sleeve is rotated, the developer is conveyed to a developing region disposed at the closest position to an image forming body on which a latent image is formed. In this way, the latent image is developed.

When the latent image on the image forming body is developed, two methods are applied. One is a contact developing method by which development is conducted when a developer layer formed on the developing sleeve rubs the surface of the image forming body. The other is a non-contact developing method by which a latent image is developed when toner particles are scattered in a small gap so as to be deposited onto the latent image on the image forming body while a development bias voltage including an AC component is impressed upon the gap. When a color image is formed by superimposing toner images on the image forming body, it is desirable to employ the non-contact developing method, because a previously formed image is not damaged by the superimposition of the next image. According to the non-contact developing method, the developing operation is conducted in the following manner: A small gap is formed in the developing region between the image forming body and the developing sleeve. This gap is formed as small as possible. A thin developer layer is formed on the developing sleeve, so that the developer layer is maintained in a non-contact condition with respect to the image forming body. While magnetic carrier of the thin developer layer adheres onto the surface of the developing sleeve, toner particles are separated from the magnetic carrier by the action of an oscillating electric field, and scattered in the gap so that the toner particles adhere onto the latent image to be developed.

The method for forming a thin developer layer on the developing sleeve is disclosed in Japanese Patent Publication Open to Public Inspection Nos. 62-191868 and 62-191869 applied by the present applicant. In the publications described above, a fore end of a resilient plate supported by a support member is directed toward the upstream direction with respect to the conveyance of developer provided on the developing sleeve, and the resilient plate is pressed against the developing sleeve so that the thickness of the developer layer conveyed on the developing sleeve can be regulated. In order to improve the above inventions, the present applicant further proposes Japanese Patent Publication Open to Public Inspection No. 1-282578. In this publication, a rod-shaped member, a portion of which is formed cylindrical, is provided, and the cylindrical portion is pressed against the surface of the developing sleeve so as to form a thin developer layer.

In the non-contact developing method in which a thin developer layer is formed on the developing sleeve surface, the following problems are encountered.

(1) When the developing gap in the developing region is small, the developing properties are affected by the fluctuation of the developing sleeve, wherein the fluctuation is caused by the eccentricity of the developing sleeve. Accordingly, step-like unevenness is caused in the formed image.

(2) When a rod-shaped rigid member is pressed against the developing sleeve to form a thin developer layer, toner particles are fused and deposited on the developing sleeve and the rigid member. Therefore, a uniformly thick developer layer can not be formed, and the developing properties are deteriorated.

(3) In order to suppress the layer thickness of developer, the number of poles of the fixed magnet is increased to restrict the height of developer bristles. Therefore, the magnetic flux density is lowered at a position of the magnet to be used for development, and excess carrier is deposited onto the surface of the image forming body.

It is an object of the present invention to provide a developing apparatus for conducting non-contact development in which the above problems are solved.

SUMMARY OF THE INVENTION

The object of the present invention can be accomplished by the following developing apparatus: In the developing apparatus, 2-component developer containing toner and magnetic carrier is used; a developing sleeve is rotated at a position opposed to the surface of an image forming body; fixed magnetic poles are provided inside the developing sleeve; a developer layer thickness regulating member is provided at a peripheral portion of the developing sleeve; a developer layer is formed on the surface of the developing sleeve in accordance with the rotation of the developing sleeve, wherein the thickness of the developer layer is regulated by the thickness regulating member; in a developing region in which the closest gap is formed between the image forming body and the developing sleeve, a latent image on the image forming body is developed with the developer layer by the action of a developing bias voltage including an AC component, wherein the development is conducted under a non-contact condition; the developing region is located at a horizontal magnetic field component position between the 2 fixed magnetic poles; the aforementioned layer thickness regulating member is composed of a non-magnetic regulating plate for cutting the height of the toner bristles which is disposed so that a minute gap can be formed between the regulating plate and the developing sleeve; the relationship $0.02 \leqq D_{SD}-H_D \leqq 0.3$ is satisfied where the closest gap is $D_{SD}$ (mm), and the developer layer thickness in the developing region is $H_D$ (mm); an amount of conveyed developer in the developing region is 5 to 40 mg/cm$^2$; and only the toner component is developed at the developing region.

In a preferable embodiment, an angle between the 2 fixed magnetic poles before and behind in the developing region is 25° to 80°, and the developing region is located approximately in the intermediate position. Further, in a preferable embodiment, the magnetic flux density of the 2 fixed magnetic poles before and behind in the developing region is not less than 400 Gauss at the region right above the surface of the developing sleeve. Also, in a preferable embodiment, the frequency of the developing bias in which an AC bias is superimposed on a DC bias is in a range from 2 to 20 KHz, and its peak-to-peak AC bias voltage $V_{p-p}$ (V) satisfies the relationship $2000 \leqq V_{p-p}/D_{SD} \leqq 5000$.

DETAILED DESCRIPTION OF THE INVENTION

Figure 1:
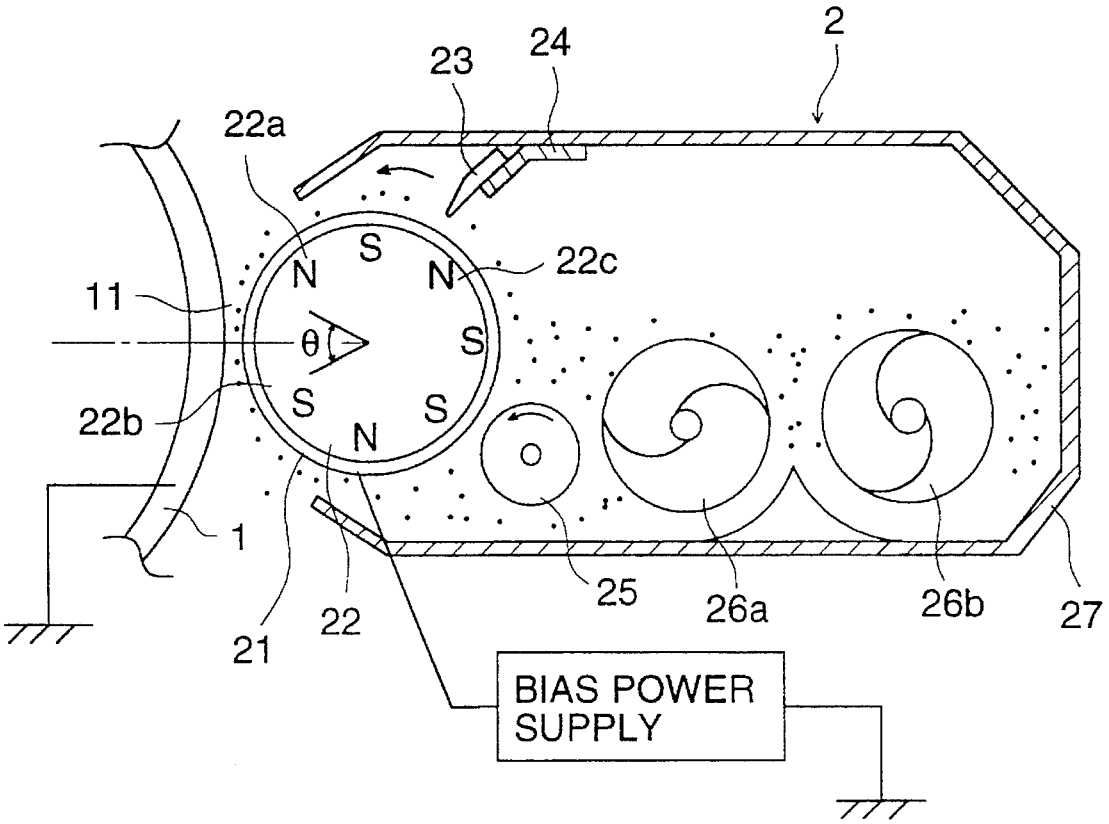
FIG. 1 is a sectional view showing the construction of the developing apparatus of the present invention.

FIG. 1 is a view showing an example of the developing apparatus of the present invention. As illustrated in the drawing, a developing apparatus 2 is opposed to an image forming body 1 in which an photoconductive layer such as an OPC photoreceptor is coated or vapor-deposited on the surface of a drum or a belt.

In the developing apparatus 2, numeral 21 is a cylindrical developing sleeve rotated in the arrowed direction, and a magnet 22 having a plurality of fixed magnetic poles are provided inside the cylindrical developing sleeve 21. Numeral 23 is a regulating plate for cutting the bristles of toner, which is opposed to the developing sleeve 21 while a minute gap is formed between the fore end of the regulating plate 23 and the surface of the developing sleeve 21. Numeral 24 is a support member for supporting the regulating plate 23 for cutting the bristles of toner. Numeral 25 is a supply roller for supplying new developer onto the developing sleeve 21. In this case, the supply roller 25 is rotated in the arrowed direction. Numerals 26*a*, 26*b* are stirring screws for stirring the 2-component developer in a casing 27.

For example, the composition of toner is described as follows.

| | |
|---|---|
| Styrene-butyl methacrylate (75:25) copolymer resin | 100 weight parts |
| Coloring agent | 10 weight parts |
| Valifast (manufactured by Orient Chemical CO.) | 0.2 weight part |
| Polypropylene, the softening temperature of which is 120° C. | 2 weight parts |

The above composition was subjected to the processes of melting, kneading, cooling, grinding and classifying, so that toner particles were obtained, the weighted average grain size of which was 8 μm. It is preferable that the grain size is in a range from 5 to 15 μm.

Examples of usable resins used for toner are: styrene resin, vinyl resin, ethyl resin, rosin denatured resin, acrylic resin, polyamide resin, epoxy resin, and polyester resin. When necessary, a coloring agent such as carbon, and a fixing property improving agent and a charging control agent are added, and then the composition is subjected to the toner particle manufacturing method of the prior art. In this way, the toner particles are provided. In the case where the manufactured toner particles are subjected to the spray-dry method or the processing to make toner particles spherical, the fluidity of the developer is improved so that the occurrence of coagulation can be avoided, further the toner particles can be uniformly mixed with carrier particles, and the conveyance and charging properties are improved.

In general, dye and pigment are used for the toner coloring agent. Especially, pigment of high weather resistance is widely used. Examples of usable pigments are: carbon black (black), benzine yellow (yellow), rhodamine B (magenta), and copper phthalocyanine (cyan). These organic or inorganic pigments are singly added, or alternatively a plurality of the organic or inorganic pigments are selected and added so that a desired image color can be obtained. It is preferable that an addition amount of pigment is 3 to 15 weight parts with respect to resin.

The magnetic carrier is made in such a manner that spherical ferrite particles, the weighted average particle size of which is 40 μm, are covered with a layer of styrene resin, the thickness of which is 0.5 μm. When the average particle size of magnetic carrier is large, the developer layer formed on the developing sleeve becomes rough. Therefore, even when an oscillating electric field is impressed, the formed toner image becomes uneven, and the toner concentration of the developer layer is lowered. Accordingly, it is difficult to perform development under the condition of high toner concentration. In the case where the average particle size of carrier is too small, the carrier particles tend to adhere onto the photoreceptor surface, and further the carrier particles tend to scatter together with the toner particles. These phenomena relate to the intensity of the magnetic field activated to the carrier particles, and also relate to the intensity of magnetization of the carrier particles. The following magnetic carrier is preferably used: The weighted average particle size is 20 to 100 μm, and the magnetic susceptibility is 20 to 50 emu/g in the magnetic field of 500 oersted.

The developer is made in the following manner:

The above magnetic carrier is mixed with toner so that the toner ratio can be 5 wt %. Further, hydrophobic silica is added by 0.5 wt %.

The 2-component developer accommodated in the casing 27 is stirred by the stirring screws 26*a*, 26*b* so that the developer can be electrically charged. Due to the foregoing, toner particles electrostatically adhere onto the spherical surfaces of magnetic carrier particles. The above developer particles are moved by the supply roller, and adhere onto the developing sleeve 21 by the magnetic force of the magnet 22. In the developing apparatus of the present invention, the layer thickness of developer adhering onto the developing sleeve 21 is regulated by the bristle regulating plate 23, and then non-contact development is conducted in the developing region where the image forming body 1 and the developing sleeve 21 are located most closely. The non-contact development will be explained in detail below.

The developing sleeve 21 is composed of a conductive metallic pipe, that is, the developing sleeve 21 is made of aluminum or stainless steel, and it is a roller, the outside diameter of which is 15 to 50 ϕmm. It is preferable that the average roughness of the developing sleeve surface is 2 to 15 μm so that the developer can be stably and uniformly conveyed on the developing sleeve surface. When the developing sleeve surface is too smooth, the developer can not be appropriately conveyed, and when the developing sleeve surface is too rough, the developed image becomes uneven.

In order to make the developing sleeve surface rough, it is preferable to employ the sand blasting processing. In the case where aluminum is used for the developing roller, it is preferable to employ the alumire processing for making the surface rough. The developing sleeve 21 is rotated at the circumferential speed of 10 to 50 cm/sec, so that new developer can be supplied to the developing region 11. The amount of developer to be supplied is related to the conveyance speed of the image forming body 1. When the amount is too small, under-development is conducted. When the rotational speed of the developing sleeve 21 is too high, toner particles tend to scatter.

The magnetic body 22 provided in the developing sleeve 21 is composed of 5 to 9 poles. An angle θ formed between the 2 fixed magnetic poles 22*a* and 22*b* is 25° to 80° in the developing region 11. It is preferable that the developing region 11 is located approximately in the middle between the 2 magnetic poles 22*a* and 22*b*. It is preferable that the magnetic flux density of the magnetic poles 22*a*, 22*b* is not less than 400 Gauss on the surface of the developing sleeve 21. When the above conditions are satisfied, a preferable magnetic field can be formed in the developing region 11.

Figure 2:
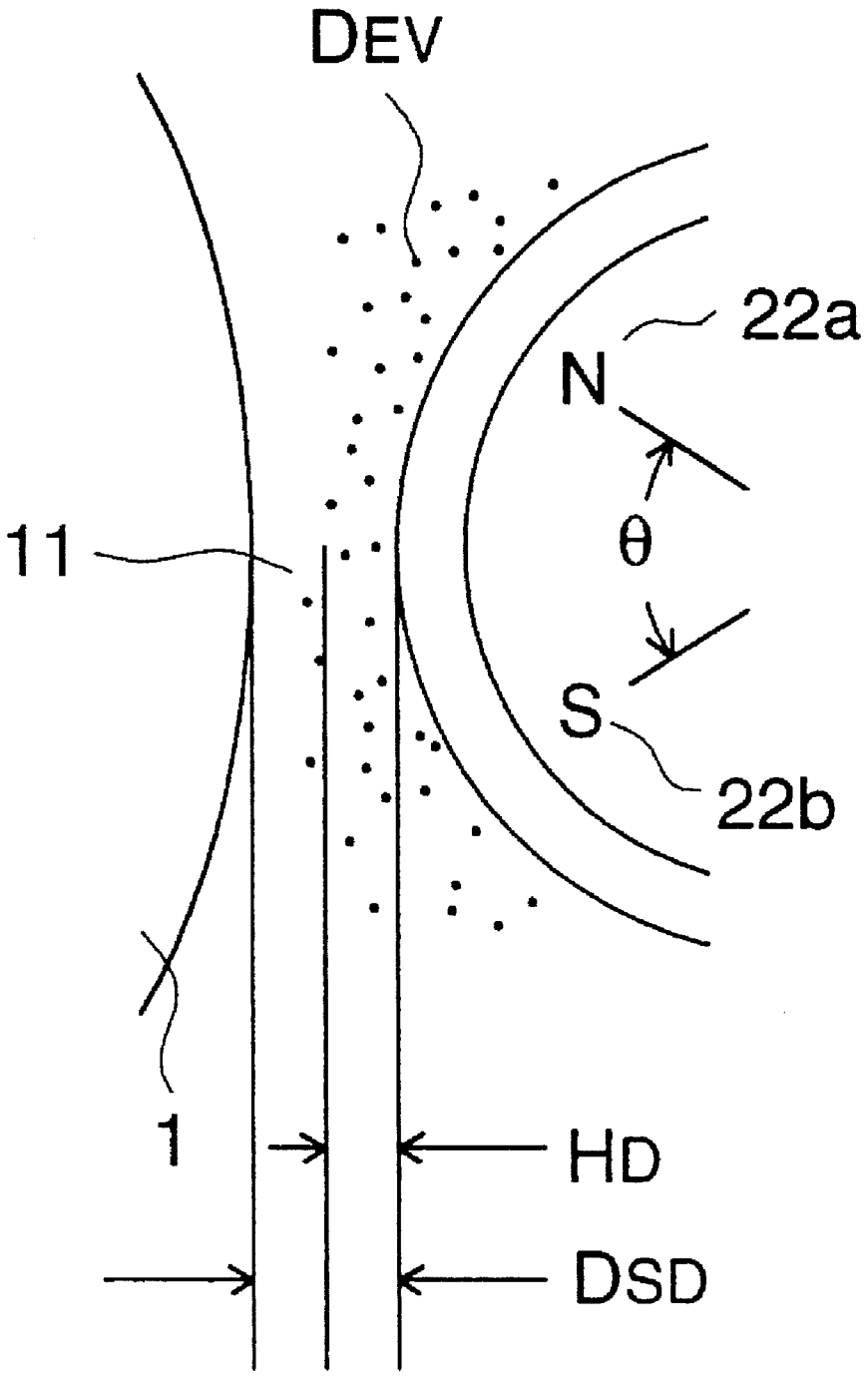
FIG. 2 is an enlarged schematic view showing circumstances of the developing region in the developing apparatus of the present invention.

FIG. 2 is an enlarged view of the developing region 11. When the closest gap formed between the image forming body 1 and the developing sleeve 21 in the developing region 11, is $D_{SD}$ (mm), and the developer layer thickness in the developing region 11 is $H_D$ (mm), the present invention satisfies (1) the condition of $0.02 \leqq D_{SD}-H_D \leqq 0.3$, and at the same time, (2) the conveyance amount W of developer is set at 5 to 40 mg/cm$^2$ in the developing region 11. The developing apparatus of the present invention is characterized as described above. In the case where the conveyance amount W is not more than 5 mg/cm$^2$, the disadvantages of the thin developer layer development system are caused. In the case where the conveyance amount W is not less than 40 mg/cm$^2$, the developer layer comes into contact with the photoreceptor (when $D_{SD}$ is fixed), and when the developer layer thickness $H_D$ is changed, an amount of deposited carrier is increased, which was confirmed by an experiment. In the magnetic pole portion, the thickness of the developer layer on the developing sleeve 11 is increased by the action of the magnetic field. In the horizontal magnetic field portion, the density of developer is higher than that of the magnetic pole portions, so that the thickness of the developer layer is reduced. In the present invention, the angle θ formed between the 2 magnetic poles 22*a* and 22*b* is 25° to 80°. Therefore, the gaps formed at the 2 magnetic poles 22*a*, 22*b* with respect to the image forming body 1 are larger than that formed in the developing region 11, and development is conducted in the developing region 11 in which a horizontal magnetic field is formed. In the case where the angle θ is not more than 25°, the 2 magnetic pole 22*a*, 22*b* portions are disposed close to the image forming body 1, so that the developer comes into contact with the image forming body 1, the developer layer is mechanically scraped off, which leads to the occurrence of color mixture. In the case where the angle θ is not less than 80°, the intensity of the magnetic field generated by the magnetic poles 22*a*, 22*b* is low, and the developer can not be sufficiently conveyed. In this developing apparatus, development is conducted in the developing region 11 when the conveyance amount W is 5 to 45 mg/cm$^2$ at which the density of the developer layer is high. Accordingly, although the gap $D_{SD}$ is approximately the same as that of the thin layer development system, the conveyance amount W of developer is larger than that of the thin layer development system. Consequently, this development system can be referred to as a thick layer non-contact development system.

Figure 3:
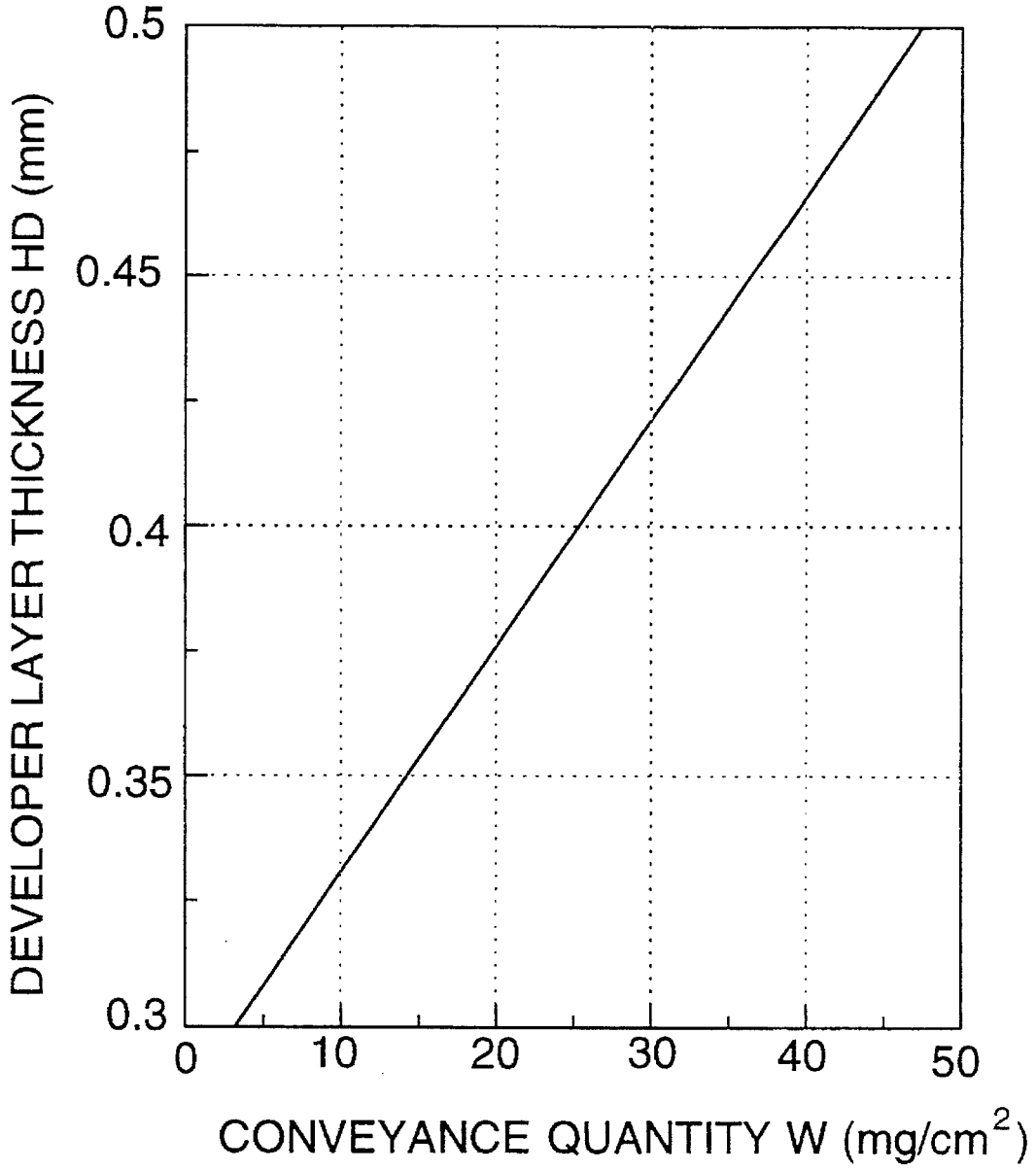
FIG. 3 is a graph showing a relation between the conveyance amount of developer and the thickness of a developer layer.

FIG. 3 is a graph showing a relation between the developer layer height HD at the horizontal magnetic field position and the conveyance amount W. As compared with a position where the bristles of developer are raised close to the magnetic pole, the conveyance amount (density) is increased at the same developer layer height. In other words, by using the horizontal magnetic field, it becomes possible to form the developer layer in which its thickness is thin but its conveyance amount (density) is relatively large. Consequently, in this developing apparatus, it is not necessary to employ the conventional developer layer thickness regulating means in which a resilient plate or a rod-shaped rigid roller is used for thin layer development. It is possible and appropriate to regulate the developer layer thickness with a bristle height regulating plate which has been used for contact-development. It is preferable that $H_D$ is between 0.2 mm and 0.5 mm.

In the developing apparatus of the present invention, a non-magnetic bristle height regulating plate 23 is disposed at the magnetic pole position 22*c* on the upstream side of the developing region 11. In this case, the bristle height regulating plate 23 is opposed to the surface of the developing sleeve 21 in such a manner that a small gap $H_C$ is formed in parallel. An amount of developer conveyed to the developing region 11 by the developing sleeve can be regulated by this bristle height regulating plate 23. The magnetic flux density on the developing sleeve surface right above the magnetic pole 22*c* is 400 to 800 Gauss. The aforementioned gap $H_C$ formed in parallel is preferably 0.1 to 0.7 mm. In the example illustrated in FIG. 1, the bristle height regulating plate 23 is composed of a non-magnetic metallic plate, which is attached to the casing 27 being supported by a supporting member 24. In order to accurately maintain the parallel gap, the bristle height regulating plate 23 is preferably positioned with reference to the surface of the developing sleeve 21 or the rotational shaft of the developing sleeve 21.

In the developing region, a bias voltage in which an AC voltage is superimposed on a DC voltage, is impressed between the image forming body 1 and the development sleeve 21. The frequency of the AC bias voltage is 2 to 20 KHz, and it is necessary that the peak-to-peak AC bias voltage $V_{p-p}$ satisfies the following relationship, depending on the gap $D_{SD}$ in the developing region 11.

$$2000 \leqq V_{p-p}/D_{SD} \leqq 5000$$

The foregoing has been found through an experiment.

Under the condition of $V_{p-p}/D_{SD} \leqq 2000$, toner particles adhering to the carrier particles on the developing sleeve 11 can not be released from the carrier particles, which causes defective development. Under the condition of $V_{p-p}/D_{SD} > 5000$, the developing conditions are sufficiently satisfied, however, toner particles of different colors deposited on the latent image portion are attracted in the case of registration, so that color mixture is caused, and further the formed image is stained by lightning. In this regard, it is preferable that $D_{sd}$ is between 0.3 mm and 0.7 mm.

Figure 4:
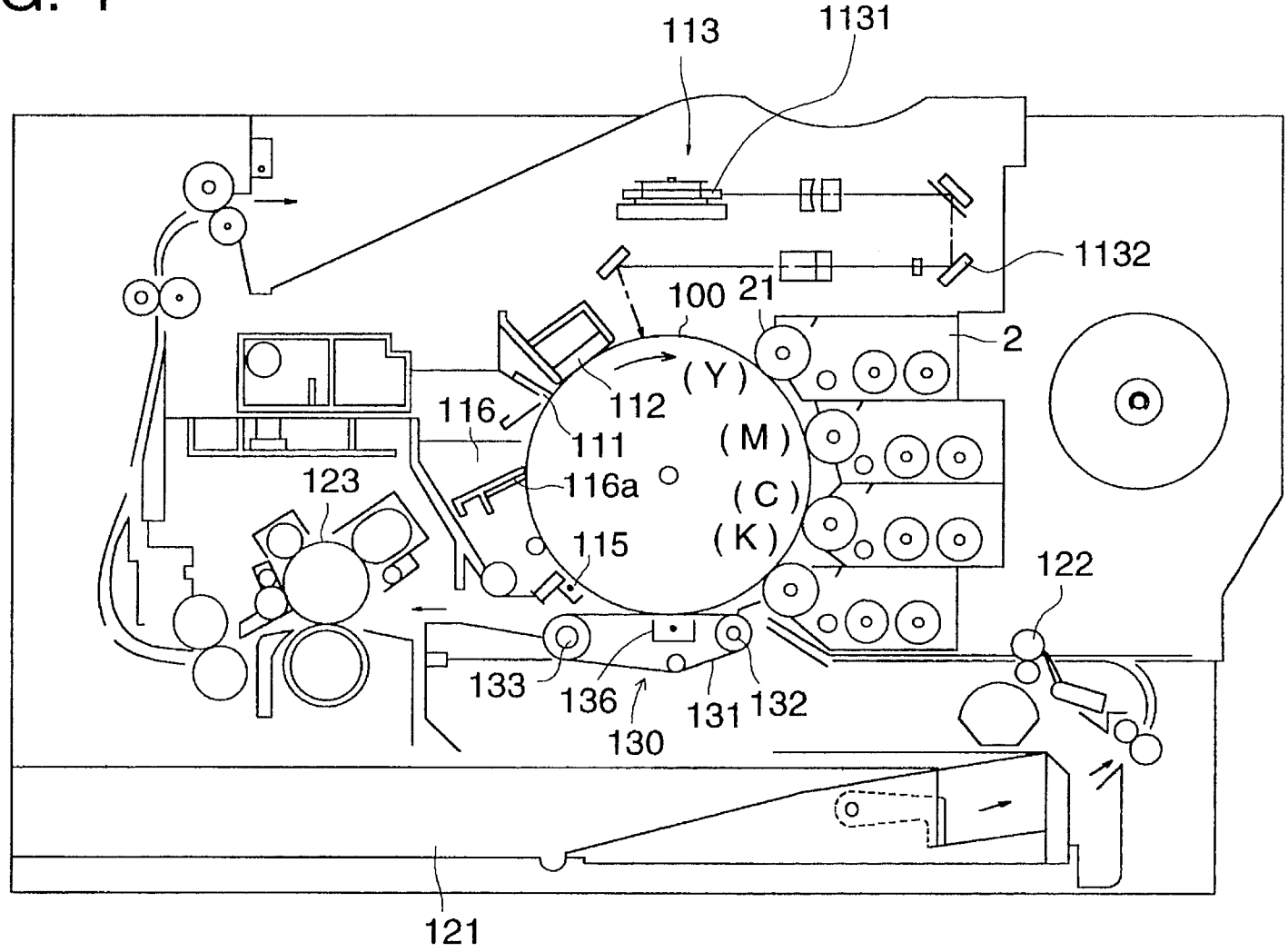
FIG. 4 is an arrangement view of the image forming apparatus provided with the developing apparatus of the present invention.

FIG. 4 is an arrangement view showing an example of the color image forming apparatus provided with the developing apparatus of the present invention. It is preferable that $V_{p-p}$ is between 1.5 kv and 2 kv, and AC bias voltage is between 5 KHz and 10 KHz.

In the drawing, numeral 100 is a photoreceptor drum which is an image forming body. The photoreceptor drum 100 is composed of a drum coated with an OPC photoreceptor. The photoreceptor drum 100 is grounded and rotated in the clockwise direction. Numeral 112 is a scorotron charger. By the action of corona discharge conducted by a grid, the electrical potential of which is maintained at $V_G$ (−550 to −850 V), and also by a corona discharge wire, the circumferential surface of the photoreceptor drum 100 is uniformly charged at $V_H$ (−600 to −800 V). Before the charging operation conducted by the scorotron charger 112, in order to erase the history of the photoreceptor, the circumferential surface of the photoreceptor is exposed to light emitted by the PCL 111 in which a light emitting diode is used. In this way, the circumferential surface of the photoreceptor is discharged.

After the photoreceptor is uniformly charged, image exposure is conducted by the image exposure means 113 in accordance with an image signal. The image scanning operation is performed as follows. A laser diode not shown in the drawing is used as a light emitting source. A beam of emitted light passes through a rotational polygonal mirror 1131 and fθ lens, and then the path of the beam is curved by a reflection mirror 1132. When the photoreceptor drum 100 is rotated (subsidiary scanning), a latent image is formed. In this example, a character portion is exposed, and a reversal latent image is formed so that the electrical potential of the character portion becomes a low potential $V_L$ (−100 V to 0).

On the periphery of the photoreceptor drum 100, developing units 2 are provided. Each developing unit contains developer composed of carrier and toner of yellow (Y), magenta (M), cyan (C) or black (K). First, the development of the first color is conducted by the developing sleeve 21 having a magnet, wherein the developing sleeve 21 is rotated while developer is deposited on its circumferential surface. The developer includes: carrier particles having cores made of ferrite that are coated with insulating resin; and toner particles which are mainly composed of polyester. The toner particles further include pigment added in accordance with the color, a charge controlling agent, silica and titanium oxide. The thickness of the developer layer on the developing sleeve 21 is regulated by the bristle height regulating plate. Then, the developer is conveyed to the developing region.

The gap formed between the developing sleeve 21 and the photoreceptor drum 100 in the developing region is determined to be $D_{SD}$ which is larger than the layer thickness of developer. In the gap, a bias voltage is impressed, which includes the AC bias voltage of $V_{p-p}$ and the DC bias voltage of $V_{DC}$ (−500 to −700 V). The polarities $V_{DC}$, $V_H$ and toner charging are the same. Therefore, toner particles which have been released from carrier particles are not deposited on the portion of $V_H$, the electric potential of which is higher than $V_{DC}$, but they are deposited on the portion of $V_L$ which is lower than $V_{DC}$, so that the latent image is made to be visual, that is, reversal development is carrier out.

After the first color image has been made visual, the image formation process of the second color starts. Therefore, the photoreceptor drum 100 is uniformly charged with the scorotron charger 112, and then a latent image of the second color image data is formed by the image exposure means 113. At this time, the discharging operation of PCL 111, which has been conducted in the first color image formation process, is not conducted, because the toner particles deposited on the image portion of the first color are scattered due to a sharp drop of electrical potential.

In this way, all the circumferential surface of the photoreceptor drum 100 is charged to the electrical potential of $V_H$. In a portion of the photoreceptor where the first color image is not formed, a latent image is formed in the same manner as that of the first color, and the latent image is developed. In the case where a portion in which the first color image is formed is subjected to development again, a latent image of $V_M$, is formed due to the shading of the first color toner and the electrical charge of toner particles, and then the latent image is developed in accordance with a difference of electrical potential between $V_{DC}$ and $V_M$. Therefore, the first color toner image and the second color toner image are superimposed on the photoreceptor. In the case where a latent image of $V_L$ is developed in a portion where the first and second color images overlap, the first and second colors become unbalanced. Therefore, an amount of exposure of the first color is reduced and an intermediate electrical potential of $V_H > V_M$(−100 to −300 V)$> V_L$ is given.

With respect to the third and fourth colors, the same image formation process as that of the second color is performed. In this way, a visual image of 4 colors is formed on the circumferential surface of the photoreceptor drum 10. Therefore, the four color toner images are superimposed on the photoreceptor.

A recording sheet P is supplied from the sheet feed cassette by the sheet feed mechanism 122. The recording sheet P is conveyed to the transfer region by the transfer belt unit 130 in which the transfer belt 131 is provided, and then a multi-color image formed on the photoreceptor drum 100 surface is simultaneously transferred onto the recording sheet P.

The transfer belt 131 is composed of an endless rubber belt, the thickness of which is 0.4 to 1.0 mm, and the resistance of which is $10^6$ to $10^{14}$ Ω·cm. The endless rubber belt includes a base made of urethane rubber, and a layer made of FLC which is provided on the surface of the base. This transfer belt 131 is provided between the support rollers 132 and 133. A voltage of $V_{PC}$ is impressed upon a shaft of the support roller 132 disposed on the upstream side. A conductive brush (not shown in the drawing), which is grounded, is provided to this shaft so that the conductive brush is used as a means for impressing an electrical charge. The conveyed recording sheet P enters between the conductive brush and the transfer belt 131, and the recording sheet P is electrically charged by the brush, so that an attraction force is generated between the recording sheet P and the transfer belt 131. After that, the recording sheet P advances to a nip portion (transfer region) formed between the photoreceptor drum 100 and the transfer belt 131. Then a transfer electric field is given from the reverse side of the transfer belt 131 by the action of the corona discharger 136 or a bias roller. In this way, the multi-color image is transferred onto the recording sheet P.

After the recording sheet P has been separated from the surface of the photoreceptor drum 100, it is subjected to discharge by means of corona discharge in which the shaft of the support roller 133 on the downstream side of the transfer belt 131 is used as an opposed electrode. The recording sheet P is separated from the transfer belt 131 after the discharge or while the discharge is being conducted. While the multi-color image is being formed, the transfer belt 131 of the transfer belt unit 130 is separated from the photoreceptor drum 100 while the transfer belt 131 is rotated around the shaft 133*a* of the support roller 133 on the downstream side.

After the recording sheet P on which the multi-color image is formed has been separated from the transfer belt unit 130, it is conveyed to the fixing unit 123 composed of 2 press rollers, wherein at least one of them is provided with a heater attached inside of the roller. When the recording sheet P is given heat and pressure by the press rollers, the toner deposited on the recording sheet P is fused so that the toner is fixed onto the recording sheet P. After that, the recording sheet P is discharged outside of the apparatus.

The residual toner on the circumferential surface of the photoreceptor drum 100 is subjected to the discharging operation by the discharger 115 for which an AC corona discharger is used. Then the residual toner is scraped off by the cleaning blade 116*a* made of rubber in the cleaning unit 116. The scraped toner is discharged from the apparatus by means of a screw, or alternatively the scraped toner is stored in the apparatus.

After the residual toner has been removed, the photoreceptor drum 100 is exposed to light by the action of the PCL 111, and then it is uniformly charged by the scorotron charger 112. Then the next image formation cycle starts. While a multi-color image is being formed, the cleaning blade 116*a* is separated from the surface of the photoreceptor, and the AC discharging operation to be conducted by the discharger 115 is maintained in an OFF-condition.

The present inventors confirmed that images of very high quality were provided by the above color image forming apparatus to which the developing apparatus of the present invention was assembled.

Specific data of the image formation will be shown as follows.

EXAMPLE 1

Outer diameter of the developing sleeve 21: 20 mmϕ

Number of revolution of the developing sleeve 21: 200 to 400 rpm

Angle θ between the 2 magnetic poles (22*a*, 22*b*) in the developing region: 60°

Magnetic flux density of the 2 magnetic poles 22*a*, 22*b* on the developing sleeve 21: 650 Gauss Gap $D_{SD}$ in the developing region 11: 0.5 mm Developer layer thickness $H_D$ in the developing region 11: 0.30 to 0.45 mm Parallel gap $H_C$ formed by the bristle height regulating plate 23: 0.20 to 0.40 mm Conveyance amount W: 20 to 45 mg/cm$^2$ Developing bias condition (AC): frequency f 8 KHz peak voltage $V_{p-p}$ 2.2 KV The above setting conditions satisfy the following expressions.

$$D_{SD}-H_D=0.05 \text{ to } 0.1 \text{ mm}$$

$$V_{p-p}/D_{SD}=4400$$

The results of the experiment will be described as follows.

(1) The formed images were seldom affected by the fluctuation of the developing sleeve 21. Even when the developing sleeve 21 fluctuated by an amount of 40 μm, unevenness was not caused in the developed image.

(2) Images of high quality were provided. Image quality was maintained high, because color toner particles were not scattered on the image forming body.

(3) Deposition of carrier particles was remarkably reduced, and practical problems were not caused.

(4) Characters were reproduced in a good condition in the developing process.

EXAMPLE 2

Outer diameter of the developing sleeve 21: 20 mmϕ

Number of revolution of the developing sleeve 21: 200 to 400 rpm

Angle θ between the 2 magnetic poles (22*a*, 22*b*) in the developing region: 60°

Magnetic flux density of the 2 magnetic poles 22*a*, 22*b* on the developing sleeve 21: 650 Gauss Gap $D_{SD}$ in the developing region 11: 0.4 mm Developer layer thickness $H_D$ in the developing region 11: 0.30 to 0.35 mm Conveyance amount W: 10 to 15 mg/cm$^2$ Developing bias condition (AC): frequency f 8 KHz peak voltage $V_{p-p}$ 1.8 KV The above setting conditions satisfy the following expressions.

$$D_{SD}-H_D=0.05 \text{ to } 0.1 \text{ mm}$$

$$V_{p-p}/D_{SD}=4500$$

The results of the experiment will be described as follows.

(1) The formed images were seldom affected by the fluctuation of the developing sleeve 21. Even when the developing sleeve 21 fluctuated by an amount of 30 μm, unevenness was not caused in the developed image.

(2) Images of high quality were provided. Image quality was maintained high, because color toner particles were not scattered on the image forming body.

(3) Deposition of carrier particles was remarkably reduced, and practical problems were not caused.

(4) Characters were reproduced in a very good condition in the developing process.

The developing apparatus of the present invention can provide the following effects.

(1) Because the developing region is formed at a position of the horizontal magnetic field component between the 2 fixed magnetic poles, the thickness of a developer layer can be increased. Therefore, step-like unevenness which tends to occur in the conventional non-contact development apparatus can be eliminated.

(2) Since the layer thickness is increased, the conventional thin layer forming means such as a resilient member or a rod member is not required. Accordingly, toner deposition on these members is eliminated. Further, it is not necessary to add a lubricant which is used for the development of the prior art. As a result, deterioration of image quality can be prevented.

(3) Since the developing region is disposed between 2 magnetic poles, it is possible to set the magnetic flux density of both poles higher. As a result, carrier deposition on the image forming body can be reduced.

(4) Density of the developer layer in the developing region is higher than that of the developer layer at the conventional magnetic pole position. Therefore, the developing gap is smaller than that of the conventional apparatus. Consequently, the developing properties can be improved compared with the conventional apparatus.

According to the developing apparatus of the present invention, the improvements discussed in (1) to (4) can be provided.

What is claimed is:

1. A developing apparatus for use with a multi-color image forming apparatus, comprising:

image forming body means having a surface, for holding a toner image;

means for containing a plurality of two-component developers, each consisting of toner having a respective color and magnetic carrier; and a plurality of developing sleeve means, located in the vicinity of said image forming body means without contacting said image forming body means, each of said plurality of developing sleeve means for supplying said toner having a respective color to said surface of said image forming body means to form a respective toner image on said surface of said image forming body means, wherein a respective toner image formed by a first of said plurality of developing sleeve means is superimposed on a respective toner image formed by a second of said plurality of developing sleeve means, each respective developing sleeve means of said plurality of developing sleeve means including;

a rotatable surface member for conveying each of said two-component developers, a plurality of magnetic poles each of which is fixed at a respective predetermined location in said rotatable surface member, wherein said plurality of magnetic poles include a north pole and a south pole, located in the vicinity of said surface of said image forming body means and having a predetermined angle therebetween with respect to an axis of said respective developing sleeve means, so that said north pole and said south pole create a horizontal magnetic field from said respective developing sleeve means toward said surface of said image forming body means at a location where said rotatable surface member is closest to said surface of said image forming body means, said predetermined angle between said north pole and said south pole being between 25° and 80°, and wherein the middle between said north pole and said south pole is substantially at said location where said rotatable surface member is closest to said surface of said image forming body means, developer layer thickness regulating means for regulating a layer thickness of one of said two-component developers provided on said rotatable surface member, and developing bias generating means for applying a developing bias voltage, including an AC component, onto said respective developing sleeve means, wherein a frequency of said developing bias voltage is between 5 KHz and 10 KHz, and at said location where said rotatable surface member is closest to said surface of said image forming body means, a layer thickness $H_D$ (mm) of said two-component developer on said rotatable surface member and a gap $D_{SD}$ (mm) between said surface of said image forming body means and said rotatable surface member satisfies:

$$0.02 \leqq D_{SD} - H_D \leqq 0.3,$$

and wherein said toner of said two-component developer conveyed to said surface of said image forming body means is in an amount of between 5 and 40 mg/cm$^2$ at said location where said rotatable surface member is closest to said surface of said image forming body means.

2. A developing apparatus for use with a multi-color image forming apparatus, comprising:

image forming body means having a surface, for holding a toner image;

means for containing a plurality of two-component developers, each consisting of toner having a respective color and magnetic carrier; and a plurality of developing sleeve means, located in the vicinity of said image forming body means without contacting said image forming body means, each of said plurality of developing sleeve means for supplying said toner having a respective color to said surface of said image forming body means to form a respective toner image on said surface of said image forming body means, wherein a respective toner image formed by a first of said plurality of developing sleeve means is superimposed on a respective toner image formed by a second of said plurality of developing sleeve means, each respective developing sleeve means of said plurality of developing sleeve means including:

a rotatable surface member for conveying each of said two-component developers, a plurality of magnetic poles each of which is fixed at a respective predetermined location in said rotatable surface member, wherein said plurality of magnetic poles include a north pole and a south pole, located in the vicinity of said surface of said image forming body means and having a predetermined angle therebetween with respect to an axis of said respective developing sleeve means, so that said north pole and said south pole create a horizontal magnetic field from said respective developing sleeve means toward said surface of said image forming body means at a location where said rotatable surface member is closest to said surface of said image forming body means, a magnetic flux density of said north pole and a magnetic flux density of said south pole each being not less than 400 Gauss at a region right above said rotatable surface member, developer layer thickness regulating means for regulating a layer thickness of one of said two-component developers provided on said rotatable surface member, and developing bias generating means for applying a developing bias voltage, including an AC component, onto said respective developing sleeve means, wherein a frequency of said developing bias voltage is between 5 KHz and 10 KHz, and at said location where said rotatable surface member is closest to said surface of said image forming body means, a layer thickness $H_D$ (mm) of said two-component developer on said rotatable surface member and a gap $D_{SD}$ (mm) between said surface of said image forming body means and said rotatable surface member satisfies:

$$0.02 \leqq D_{SD} - H_D \leqq 0.3,$$

and wherein said toner of said two-component developer conveyed to said surface of said image forming body means is in an amount of between 5 and 40 mg/cm$^2$ at said location where said rotatable surface member is closest to said surface of said image forming body means.

3. A developing apparatus for use with a multi-color image forming apparatus, comprising:

image forming body means having a surface, for holding a toner image;

means for containing a plurality of two-component developers, each consisting of toner having a respective color and magnetic carrier having a magnetic susceptibility between 20 and 50 emu/g in a magnetic field of 500 oersted; and a plurality of developing sleeve means, located in the vicinity of said image forming body means without contacting said image forming body means, each of said plurality of developing sleeve means for supplying said toner having a respective color to said surface of said image forming body means to form a respective toner image on said surface of said image forming body means, wherein a respective toner image formed by a first of said plurality of developing sleeve means is superimposed on a respective toner image formed by a second of said plurality of developing sleeve means, each respective developing sleeve means of said plurality of developing sleeve means including:

a rotatable surface member for conveying each of said two-component developers, a plurality of magnetic poles each of which is fixed at a respective predetermined location in said rotatable surface member, wherein said plurality of magnetic poles include a north pole and a south pole, located in the vicinity of said surface of said image forming body means and having a predetermined angle therebetween with respect to an axis of said respective developing sleeve means, so that said north pole and said south pole create a horizontal magnetic field from said respective developing sleeve means toward said surface of said image forming body means at a location where said rotatable surface member is closest to said surface of said image forming body means, developer layer thickness regulating means for regulating layer thickness of one of said two-component developers provided on said rotatable surface member, and developing bias generating means for applying a developing bias voltage, including an AC component, onto said respective developing sleeve means, wherein a frequency of said developing bias voltage is between 5 KHz and 10 KHz, and at said location where said rotatable surface member is closest to said surface of said image forming body means, a layer thickness $H_D$ (mm) of said two-component developer on said rotatable surface member and a gap $D_{SD}$ (mm) between said surface of said image forming body means and said rotatable surface member satisfies:

$$0.02 \leqq D_{SD} - H_D \leqq 0.3,$$

and wherein said toner of said two-component developer conveyed to said surface of said image forming .body means is in an amount of between 5 and 40 mg/cm$^2$ at said location where said rotatable surface member is closest to said surface of said image forming body means.

* * * * *